US005788128A

United States Patent [19]

Hickey

[11] Patent Number: 5,788,128

[45] Date of Patent: Aug. 4, 1998

[54] HIGH VISCOSITY LOW PRESSURE NON-CONTACT GLUE-DISPENSER

[76] Inventor: Patrick J. Hickey, Heatherwood #3, East Wellow, Romsey, Hampshire, England, S0516 AW

[21] Appl. No.: 884,918

[22] Filed: Jun. 30, 1997

[51] Int. Cl.[6] ..... B67D 3/00

[52] U.S. Cl. ..... 222/504; 222/559

[58] Field of Search ..... 222/504, 559, 222/542

[56] References Cited

U.S. PATENT DOCUMENTS 3,054,533 9/1962 Kurek ..... 222/504

4,066,188 1/1978 Scholl et al. ..... 222/504

4,465,212 8/1984 Boone ..... 222/559

*Primary Examiner*—Philippe Derakshani

*Attorney, Agent, or Firm*—Zachary T. Wobensmith, III

[57] ABSTRACT

A non-contact glue applicator for dispensing high viscosity adhesives in a straight line onto card stock or heavy paper, which includes an outer body connected to source of glue under pressure, which body has an extruder nozzle attached thereto, which body also carries an activator solenoid to which a metallic needle is attached which carries an O-ring seal which is in selective contact with the nozzle to permit controlled adhesive flow from the nozzle orifice.

4 Claims, 2 Drawing Sheets

20
27
10
17
18
12
15
16
21
32
31
30
26
25
11
14
33
35
45
41
40
46
34
47
48
60
49
64
50
55
57
56

HIGH VISCOSITY LOW PRESSURE NON-CONTACT GLUE-DISPENSER

BACKGROUND OF THE INVENTION

1. Field of the Invention

This invention relates to a non-contact glue applicator of the type which dispenses high viscosity adhesives through an extruder nozzle, which dispensing is controlled by a needle valve assembly.

2. Description of the Prior Art

High viscosity adhesives, that is adhesives which have a high solids content and are stiff, are difficult to extrude from a nozzle with any degree of reliability.

It is important in the extrusion of high viscosity P.V.A. adhesives that the needle valve assembly be precisely centered in the extruder nozzle orifice, and that during operation it does not veer to one side, resulting in uneven or excessive extrusion of adhesive, and consequently less than satisfactory gluing.

The glue applicator of the invention forces the adhesive to follow a central course through the nozzle orifice, providing repeatable results, does not suffer from the disadvantages of the prior art, and provides positive advantages.

SUMMARY OF THE INVENTION

This invention relates to a non-contact glue applicator which includes an outer body connected to a source of high viscosity adhesive under pressure, which has an attached extruder nozzle for extruding a line of adhesive onto paper stock, with a solenoid activated needle valve controlling the flow of adhesive from the nozzle.

The principal object of the invention is to provide a non-contact glue applicator for extruding high viscosity adhesives.

A further object of the invention is to provide a glue applicator that is consistent in operation.

A further object of the invention is to provide a glue applicator wherein the nozzle internal configuration is instrumental in causing the adhesive to be extruded in a straight line.

A further object of the invention is to provide a glue applicator that is sturdy and reliable in operation.

A further object of the invention is to provide a glue applicator that is simple and inexpensive to construct.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are merely illustrative and that various modifications and changes can be in the structures disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Figure 1:
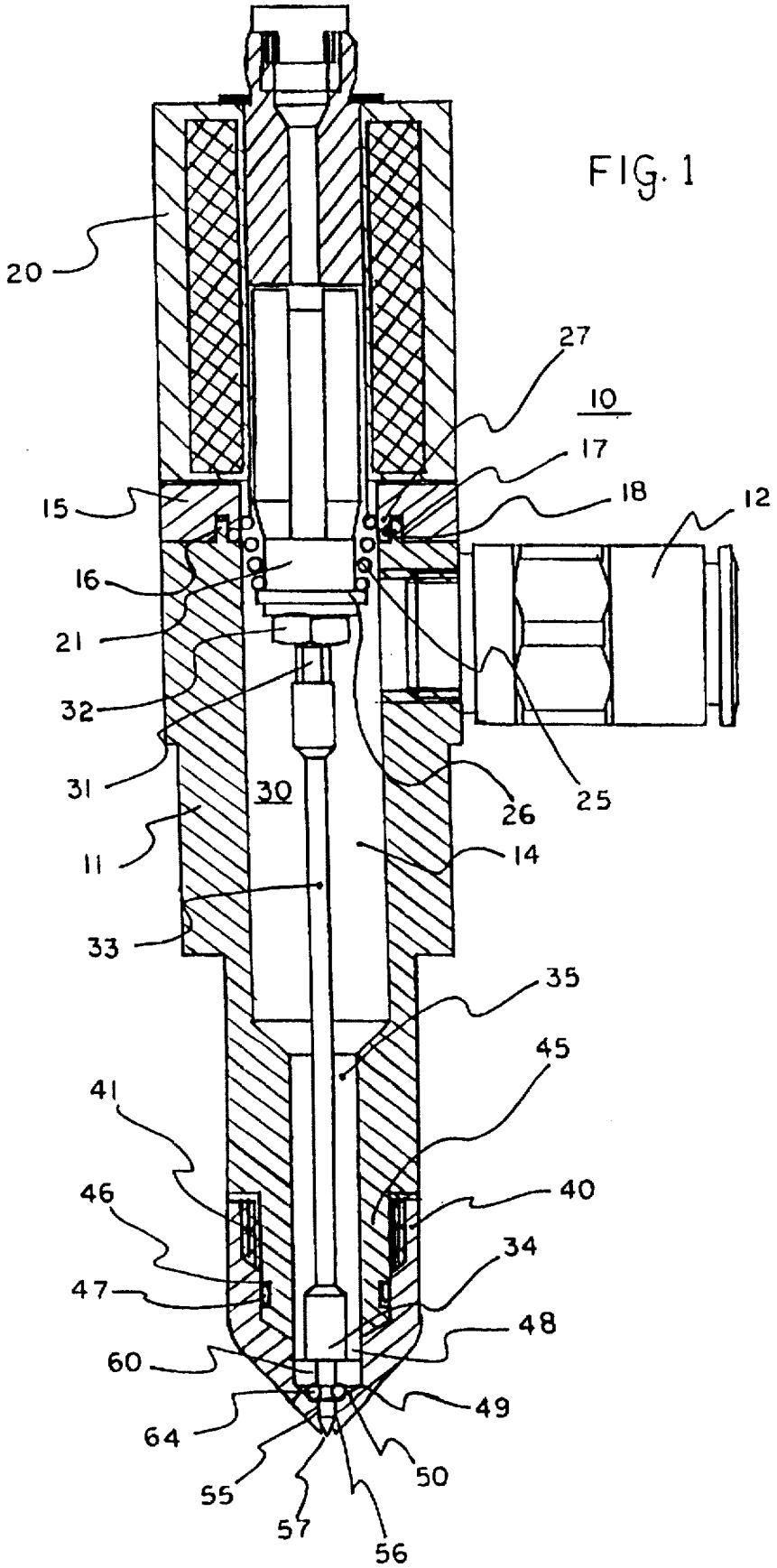
FIG. 1 is a sectional view of one embodiment of the non-contact glue applicator of the invention.
Figure 2:
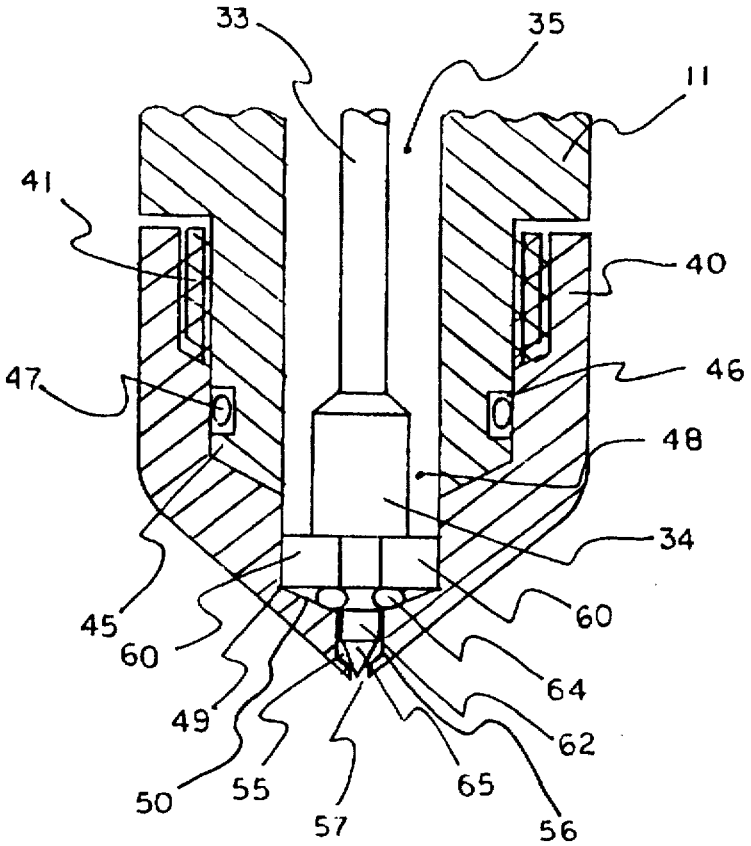
FIG. 2 is a fragmentary, sectional view, enlarged of a portion of the applicator of FIG. 1.
Figure 3:
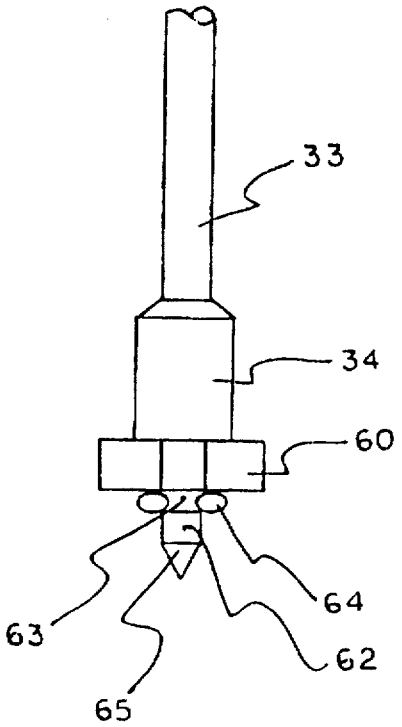
FIG. 3 is a fragmentary plan view of the needle valve assembly of the invention.

Referring now more particularly to FIGS. 1, 2 and 3 of the drawings, one embodiment of the non-contact glue applicator 10 is therein illustrated.

The applicator 10 includes an outer body 11 of cylindrical configuration, which is hollow and connected by a fitting 12 to a source of high viscosity adhesive under pressure (not shown).

The body 11, which is preferably constructed of Delrin plastic, has a chamber 14, which communicates with the fitting 12, and a flange plate 15, which is secured thereto by a plurality of screws (not shown). The body 11 has a rim 16 which extends into a groove 17 in plate 15, with an O-ring 18 between the plate 15 and the body 11. An actuator solenoid 20 is provided, secured to the plate 15, of well known type such as a Webber 12 volt AC solenoid.

The solenoid 20 has an actuator rod 21 extending therefrom into chamber 14, with a spring 25 thereon engaging a ring 26 on rod 21, and a shoulder 27 in flange plate 15, urging the rod 21 down into chamber 14.

The rod 26 is engaged with a needle valve assembly 30, which has an extension 31, detachably engaged therewith and retained therein by a nut 32 carried on rod 26. The needle valve assembly is constructed of material resistant to the adhesives and preferably of stainless steel or brass.

The needle valve assembly 30 includes a shaft 33 extending from extension 31, with an enlarged cylindrical end 34 thereon. The shaft 33 extends through the chamber 14 and into a reduced diameter passageway 35 in body 11.

An extruder nozzle 40 is provided detachable engaged with body 11 by threads 41, which nozzle 40 is preferably of a suitable plastic such as Delrin.

The body 11 has a reduced diameter portion 45, which is engaged with the nozzle 40, with a groove 46 having an O-ring 47 therein bearing against nozzle 40. The O-ring 47 is constructed of a material resistant to the adhesives used, and is preferably of Viton. The nozzle 40 has a passageway 48 therein of the same diameter as passageway 35, which terminates at a shoulder 49, with a cone-shaped, downwardly sloping surface 50 extending to a further reduced diameter passageway 55, which terminates at a shoulder 56, which has a nozzle orifice 57 extending therefrom.

Figure 4:
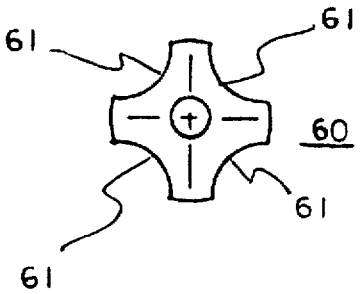
FIG. 4 is an end view of the needle valve assembly of FIG. 3.

The needle end 34 has an abbreviated ring 60 thereon, which is illustrated in FIG. 4, and provided with cutouts 61, four being illustrated. The ring 60 which is carried in passageway 48, helps to center the end 34, and improve adhesive flow to be described.

The needle end 34 has a cylindrical projection 62 of reduced diameter extending therefrom with a groove 63 which carries an O-ring 64, preferably of Viton, which can engage the surface 50 at its meeting with the passageway 55 to seal the passageway 55 to be described.

As discussed, the properties and high solid content of some heavy adhesives make it difficult to extrude a straight line from the nozzle with any reliability. To overcome this problem, the small cone shaped surface 50 projects beyond the O-ring seal into the nozzle passageway 55. The surface effects of the surface 50 and passageway 55 upon the adhesive force it to follow a central course through the nozzle orifice, thus providing repeatable results at each opening of the valve seal.

The projection 62 has a cone-shaped tip 65 extending therefrom, which extends into the nozzle orifice 57. The size of the nozzle orifice 57 is determined by the volume and viscosity of adhesive to be dispensed, and can be changed by installing nozzles with different sizes of orifices.

The mode of operation will now be described.

The glue application 10 is useful with any machine which requires a line of adhesive on demand, and is particularly useful with paper folding machines where one or more lines of high viscosity adhesive are deposited on paper stock.

The applicator 10 is installed on the equipment (not shown) in a vertical position and paper stock (not shown) to which a line of adhesive is to be applied is brought under the applicator 10.

A suitable high viscosity adhesive (not shown) which can be in the range of 1000 to 3,000 centipoises is introduced through fitting 12 into chamber 14.

The solenoid 20 is actuated and rod 21 moves into the solenoid against the force of the spring 25.

The adhesive flows through chamber 14 into passageway 35 and into passageway 48. The upward movement of rod 21 urges the needle valve assembly 30 upwardly, and the O-ring 64 out of engagement with surface 50, so that adhesive can flow past cut outs 61, down surface 50 into passageway 55, and out nozzle orifice 57.

The configuration of the sloping surface 50 in relation to the passageway 55 urges the adhesive to flow toward and through it, and the ring 60 centers the tip 65 so that the surface effects cause the adhesive to be forced out orifice 57, in a constant stream.

When sufficient adhesive has been dispensed, the solenoid 20 is deactuated, and rod 21 moves O-ring 64 into contact with surface 50, thereby shutting off the flow of adhesive out of nozzle Orifice 57.

The operation can be repeated as required, with a consistent precisely controlled line of adhesive dispensed or extruded on to the paper stock.

It will thus be seen that a non-contact glue applicator has been provided with which the objects of the invention are achieved.

I claim:

1. A non-contact glue applicator for dispensing high viscosity adhesives which comprises, a hollow outer body;

a source of adhesive under pressure connected to said body;

actuator solenoid means connected to one end of said body;

a chamber in said body;

an activator rod extending from said solenoid means, into said chamber;

needle valve means detachably carried by said rod;

an extruder nozzle detachably mounted to said body at the end opposite from said solenoid means;

said body having a passageway of reduced diameter in communication with said chamber;

said nozzle having a first passageway in communication with said body passageway;

said needle valve means includes a shaft;

a needle end extending from said shaft;

a ring on said end bearing on said first nozzle passageway;

said ring having cutouts spaced there around to permit adhesive to flow therethrough;

said first nozzle passageway terminating at a cone-shaped downwardly sloping surface;

an O-ring carried on said needle end in selective engagement with said surface;

a second passageway in said nozzle in communication with said first nozzle passageway;

a nozzle orifice in communication with said second passageway; and said needle end has a cone-shaped tip for guiding the adhesive through the second passageway and out of the orifice.

2. A non-contact glue applicator as defined in claim 1 in which, said applicator body and said extruder nozzle are constructed of Delrin plastic.

3. A con-contact glue applicator as defined in claim 1 in which, said needle valve means is constructed of stainless steel.

4. A non-contact glue applicator as defined in claim 1 in which, said needle valve means is constructed of brass.

* * * * *